United States Patent [19]

Bigelow, Jr. et al.

[11] Patent Number: 4,637,179

[45] Date of Patent: Jan. 20, 1987

[54] KNOCKDOWN BUILDING

[76] Inventors: Floyd E. Bigelow, Jr., 10802 Pine Bayou, Houston, Tex. 77024; Floyd E. Bigelow, III, 7903 Midland Forest, Houston, Tex. 77088; William H. Bigelow, 6903 Oakwood Grove, Houston, Tex. 77040

[21] Appl. No.: 576,897

[22] Filed: Feb. 3, 1984

[51] Int. Cl.[4] ..... E04H 1/00

[52] U.S. Cl. ..... 52/79.5; 52/125.2; 52/125.6; 52/586

[58] Field of Search ..... 52/79.1, 79.3, 79.5, 52/79.6, 79.7, 64, 66, 71, 143, 586, 125.1, 125.2, 125.6

[56] References Cited

U.S. PATENT DOCUMENTS

| | | | |
|---|---|---|---|
| Re. 25,827 | 8/1965 | Bigelow, Jr. | 52/143 |
| 2,731,680 | 1/1956 | Bolt | 52/143 |
| 3,133,322 | 5/1964 | Douglas | 52/288 |
| 4,007,833 | 2/1977 | Bigelow | 52/143 |
| 4,034,524 | 7/1977 | Fromme et al. | 52/143 |
| 4,148,165 | 4/1979 | Wanatabe | 52/125.6 |
| 4,161,089 | 7/1979 | Omansky | 52/262 |
| 4,216,633 | 8/1980 | Grauer et al. | 52/125.6 |
| 4,269,006 | 5/1981 | Larrow | 52/79.1 |
| 4,299,065 | 11/1981 | Fairgrieve | 52/79.7 |
| 4,327,529 | 5/1982 | Bigelow, Jr. et al. | 52/143 |
| 4,364,206 | 12/1982 | Wybauw | 52/79.7 |

FOREIGN PATENT DOCUMENTS

| | | | |
|---|---|---|---|
| 2519841 | 11/1975 | Fed. Rep. of Germany | 52/79.5 |
| 370565 | 8/1963 | Switzerland | 52/125.6 |
| 107413 | 6/1917 | United Kingdom | 52/143 |
| 2075083A | 11/1981 | United Kingdom | 52/79.5 |
| 557157 | 6/1977 | U.S.S.R. | 52/79.5 |
| 684110 | 9/1979 | U.S.S.R. | 52/79.5 |

*Primary Examiner*—John E. Murtagh
*Assistant Examiner*—Andrew Joseph Rudy
*Attorney, Agent, or Firm*—Vinson & Elkins

[57] ABSTRACT

A knockdown building with a floor made up of several panels having a core of insulation material and structural members extending around the periphery of the core made of wood and received between the plywood of the floor panels in which a simple angle iron frame coupled with the strength of the peripheral wooden structural members provides the strength necessary for handling and tailgating a building. The roof is flat and buildings may be stacked directly one upon the other with force transmitted directly through structural members to the angle iron skid. Due to the flat roof, several buildings may be stacked directly one upon the other eliminating the need for stacking racks and due to the simple angle iron skid replacing the massive oil field-type skid of past construction the cube for a building prepared for shipment is drastically reduced.

7 Claims, 9 Drawing Figures

KNOCKDOWN BUILDING

This invention relates to buildings and particularly to knockdown buildings.

It has been customary for many years to ship a knockdown prefabricated building on an oil field-type skid which includes stacking racks permitting buildings and their supporting skids to be stacked one upon the other. See Bigelow U.S. Pat. No. Re. 25,827. It has been customary to stack the walls of a building on the floor and then support the roof on top of the walls and ship the building as a package. See Bigelow U.S. Pat. No. 4,007,833. In the past there has been a massive oil field-type skid utilized with all of these types of buildings. As the package was not designed to transmit force from the roof to the skid a stacking rack was utilized to permit stacking of buildings while protecting the building against damage from a superimposed building or buildings. This has resulted in a substantial size cube for shipping which is a particular disadvantage when the buildings are moved by ship.

STATEMENT OF INVENTION

This invention provides a knockdown building designed such that weight may be transferred through structural members contained within the walls and roof to the floor of the building and thence to a small skid permitting buildings to be stacked one upon the other without the use of stacking racks. The invention further provides a floor and a simple angle iron skid which in combination are strong enough to permit handling or tailgating of the building thus eliminating the massive oil field-type skid utilized in the past and shown in the above reissue patent.

It is an object of this invention to provide a knockdown building in which the conventional massive oil field-type skid is replaced by a sturdy floor construction in combination with a simple angle iron skid attached with the inner face of the angle iron abutting the bottom and side of the floor providing sufficient strength to permit tailgating of the building.

Another object is to provide a knockdown building in which the floor, walls and roof are each designed as integral structures which will support a load when the walls are laid down on the floor and the roof supported on the walls eliminating the need for stacking racks.

Another object is to provide a knockdown building in which the floor, walls and roof are designed to permit laying down of the walls on the floor and resting of the roof on the walls with structural members superimposed one upon the other so that weight is transmitted through the structural members to the skid permitting buildings to be stacked one upon the other without damage.

Another object is to provide a knockdown building with a floor constructed of panels with adjacent panels splined together and structural members extending about the periphery of the floor and attached thereto with an angle iron frame with the inside of the angle abutting the bottom and sides of the floor and attached to the floor.

Other objects, features and advantages of the invention will be apparent from the drawings, the specification and the claims.

In the drawings wherein an illustrative embodiment of this invention is shown and wherein like reference numerals indicate like parts:

The building includes a floor indicated generally at 11 supported upon a skid indicated generally at 12. Side walls indicated generally at 13 and 14 and end walls indicated generally at 15 and 16 are erected upon the floor and a roof indicated generally at 17 is supported on the walls when the building is in the erected condition.

Referring first to the floor 11, the floor is made up of a plurality of spaced wooden structural members and upper and lower sheets of plywood secured to the structural members. In accordance with this invention the floor has structural members extending along two opposed sides of the floor and preferably structural members extend about the entire periphery of the floor. Further, it is preferable that the floor be made up of a plurality of panels of upper and lower sheets of plywood having bonded therebetween a cellular insulation material.

Figure 7:
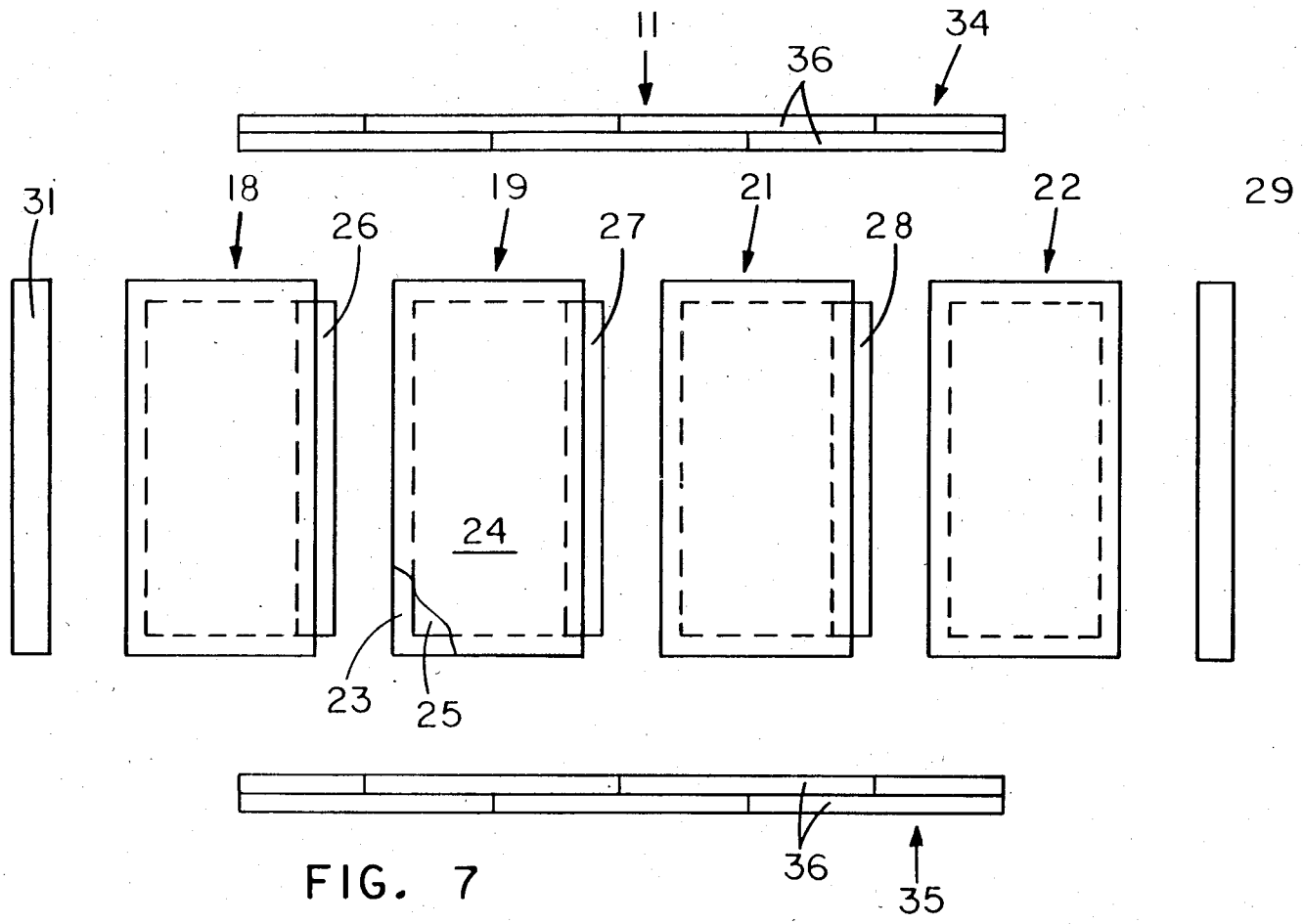
FIG. 7 is a schematic plan exploded view of the floor of the building of this invention.

Referring particularly to FIG. 7, the floor of the eight foot by sixteen foot floor illustrated is made up of four panels indicated generally at 18, 19, 21 and 22. Each panel is provided by upper and lower sheets of plywood preferably four foot by eight foot by five-eighths inch with the lower panel shown at 23 and the upper panel at 24 having bonded therebetween a sheet of cellular insulation material 25 which may be polystyrene.

To provide for splining the floor panels together the panels 18, 19 and 21 are provided with splines of nominal four inch by four inch dimension which in finished wood measures three and one-half inch by three and one-half inch. Such splines are shown at 26, 27 and 28.

In fabricating the several panels removable spacers of the same size as the splines are provided about the periphery of the panel where no spacers are provided to hold the upper and lower sheets of plywood 23 and 24 in proper spaced relationship while the panels are contained in the press during bonding of the insulation material and the plywood to each other. The splines 26, 27 and 28 are suitably secured to the plywood 23 and 24 as by bonding and/or conventional nailing.

During assembly the several panels are splined to each other by the splines 26, 27 and 28 and the plywood of one panel is secured to the spline of an adjacent panel in any conventional manner as by nailing.

A peripheral structural member is provided about the floor both for strength and for support and attachment to the remainder of the building. At the ends, the structural member may be provided by single four by fours extending the length of the panel as shown at 29 and 31. In a small building the structural members extending along the sides of the building could be single four by fours. In long buildings of, for instance, twenty-four feet, the side structural members such as indicated generally at 34 and 35 would be made up of a plurality of two by fours overlapping at their ends by staggering the two by fours 36 as shown in FIG. 7. The several two by fours 36 are nailed together in the conventional overlapped manner to provide a substantially continuous structural member 34 and like structural member 35 on opposite sides of the building.

Figure 3:
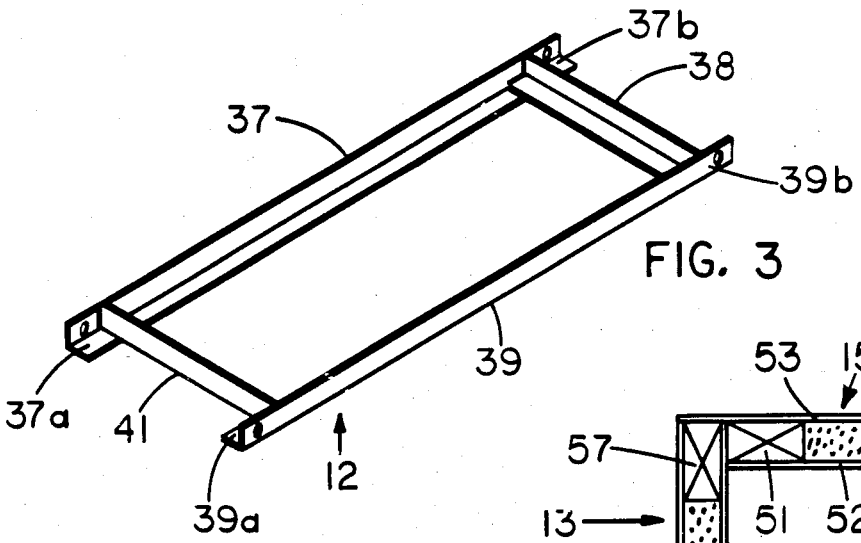
FIG. 3 is a schematic illustration of an angle iron skid constructed in accordance with this invention.
Figure 8:
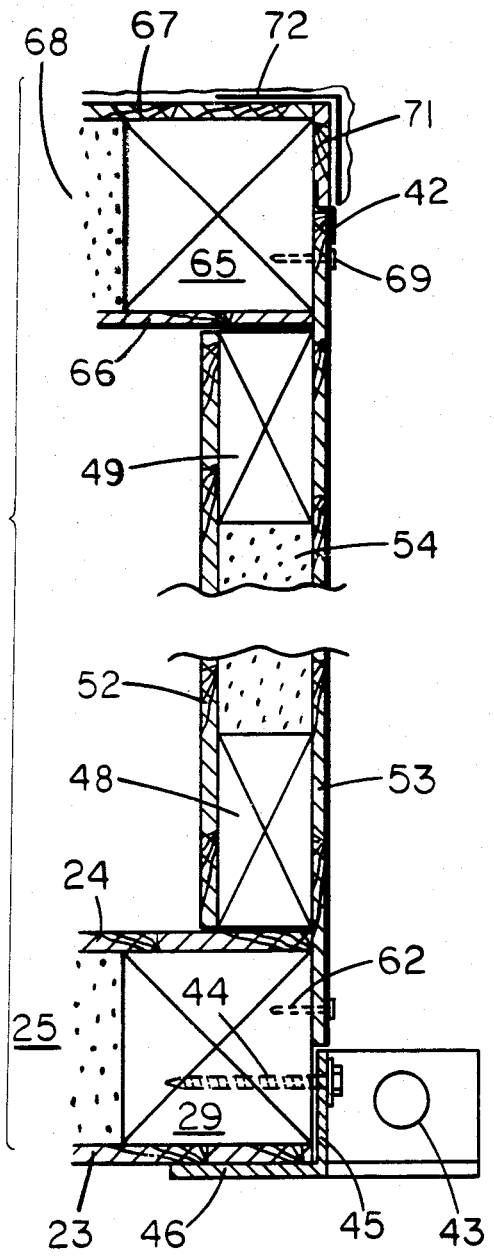
FIG. 8 is a view along the lines 8—8 of FIG. 1 on an enlarged scale.
Figure 9:
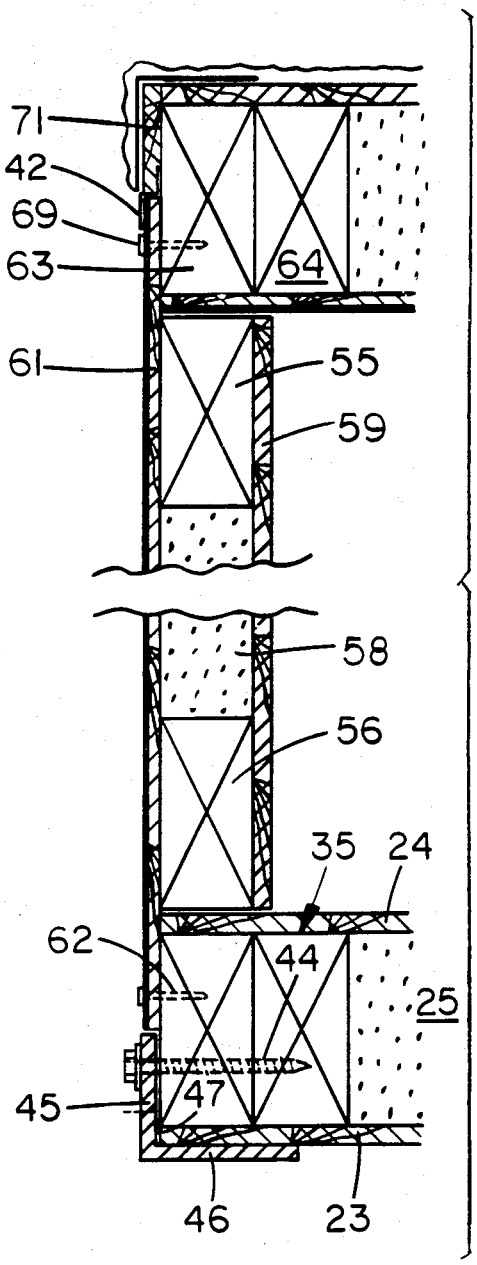
FIG. 9 is a sectional view along the lines 9—9 of FIG. 1 on an enlarged scale.

A metal skid best shown in FIGS. 3, 8 and 9 is made up of four angle iron members 37, 38, 39 and 41. The several angle iron members are secured together in rectangular form as by welding. One of the angle iron members extends from the rectangular configuration at each corner of the building. In the illustrative embodiment the angle irons 37 and 39 extend beyond the end angle iron members 38 and 41 to provide the two end extensions 37*a* and 37*b* on one side of the building and the extensions 39*a* and 39*b* on the other side of the building. A hole 43 extends through each extension to provide for reception of a lifting device such as a hook so that the building may be lifted utilizing a conventional gin pole with four lifting hooks spaced by a spreader in the conventional manner.

As shown in FIGS. 8 and 9, the angle iron skid 12 is secured to the peripheral structural member of the floor 11 by lag bolts 44. Preferably the skid is secured to the peripheral structural member of the floor with lag bolts on three foot centers.

The angle iron skid is made of metal, preferably iron, and has a quarter inch wall thickness with an upstanding flange portion 45 of two and one-half inches and a flat flange portion 46 of three inches. These dimensions can vary with the design but an angle iron of the illustrated dimensions will cooperate with the structural members in the floor to support a building up to twenty-four feet in length and greater which may be lifted in knockdown condition with the usual gin pole and which may be tailgated either in knockdown condition or in erected condition onto a truck bed in the conventional manner.

It will be noted that the interior side 47 of the angle iron skid faces the floor of the building and engages the bottom and the side of the floor. This presents the exterior of the bottom flange 46 as a flat horizontal surface to provide on each side of the building a flat bearing surface permitting the building to be tailgated onto a trailer by sliding the trailer and lower face of the angle iron skid relative to each other to tailgate the building onto a truck or a trailer.

Figure 1:
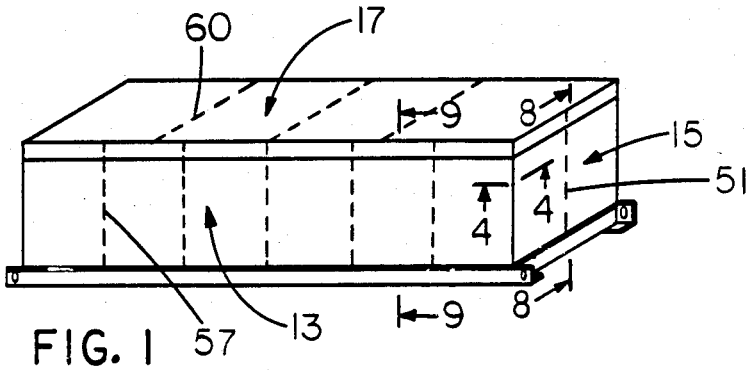
FIG. 1 is a schematic illustration of a building of this invention in erected form.
Figure 4:
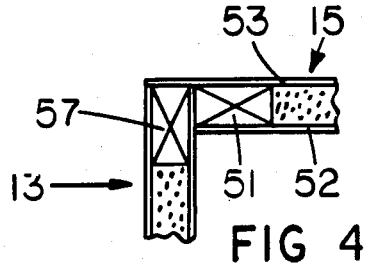
FIG. 4 is a view along the lines 4—4 of FIG. 1 on an enlarged scale.

The wall construction is shown in FIGS. 4, 8 and 9. Each end wall 15 and 16 is provided with a bottom plate 48 and a top plate 49 which may be provided by horizontally extending two by fours. At each end and at selected points intermediate the ends the end walls are provided with vertical studs 51 which again may be of two by four material. The end wall is provided with an inner skin 52 and an outer skin 53. These inner and outer skins are preferably of plywood, such as a five thirty-seconds thick panelling for the interior wall 52 and an exterior plywood panel having aluminum finish material secured thereto to provide an aluminum clad plywood sheet or skin. Vertical studs similar to 51 are provided intermediate the two ends of the end wall (see FIG. 1). From FIG. 4 it will be noted that the exterior skin 53 extends beyond the end stud 51 a sufficient distance to overlap and provide a flush finish with the side wall 13.

Preferably the end walls are provided between studs and plates with suitable insulation material 54 which may be polystyrene.

The side walls 13 and 14 are constructed in the same manner as the end walls. Upper and lower plates 55 and 56 are provided by horizontally extending two by fours spaced by vertical two by fours 57 at each end of the side wall with similar two by fours spaced at intervals along the side walls. The side walls have insulation material 58 between the structural members and they are finished with interior and exterior skins 59 and 61 identical to those of the end walls.

In the case of both the side and end walls the exterior skin extends slightly above and below the upper and lower plates. The lower extension of the exterior skin is secured to the floor by a plurality of fasteners such as nails 62 with the side and end walls supported on the floor.

The extension of the side walls beyond the top plates 49 and 55 permit the side walls to be nailed to the roof perimeter members as by fasteners or nails 69 (FIGS. 8 and 9).

The vertical height of the side and end walls will be approximately the same as the width of the floor so that the end walls and side walls may be laid down over the floor and in their laid down condition the perimeter structural members extending about each side and end wall will preferably overlie the perimeter structure members of the floor and the weight of the walls and anything supported thereon will be transmitted directly through these structural members to the floor and ultimately to the skid 12. Preferably the vertical dimension of the exterior skins 53 and 61 will be equal to or less than the width of the floor so that the entire walls will be supported on the floor without extending beyond the perimeter of the floor.

Figure 6:
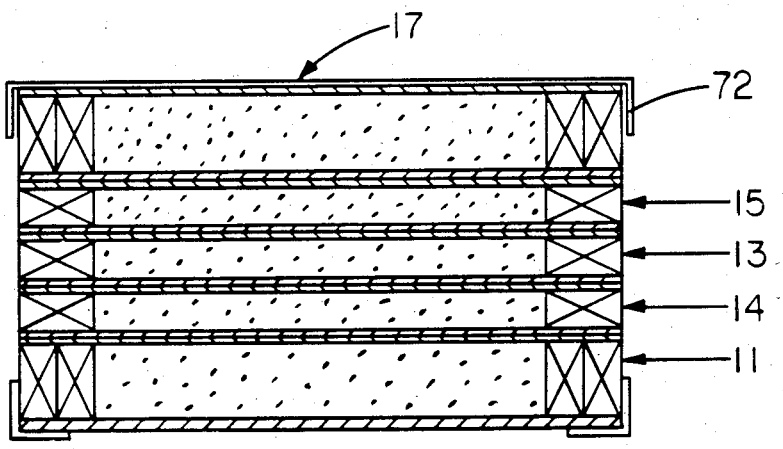
FIG. 6 is a sectional view along the lines 6—6 of FIG. 2 illustrating one of the buildings in knockdown form with the structural members superimposed upon each other to transmit load through the knockdown building.

While it is preferred that the top and bottom plates of the walls be located to overlie and underlie the structural members at the sides of the floor and roof to directly transfer load, such is not necessary. The plates, studs and plywood inner and outer skins are fastened to each other and provide structural panels of sufficient strength to support the load of several buildings as shown in FIG. 6. The absence of window and door molding, protruding fixtures and the like permit flush engagement of floor, walls, and roof which distributes the load without damage during shipment.

In the preferred form the vertical dimension of the side walls is such that when the walls are laid down on the floor the vertical dimension of the outside skin 53 and 61 is approximately equal to or less than the width of the floor. These extensions of the outer skin above and below the upper and lower plates are on the order of two inches leaving the upper and lower plates of the wall supported on the interior one inch of the three and one-half inch wide perimeter structural members of the floor. This will be adequate for transmitting the weight of the walls and structures thereabove directly to the floor and thence to the skid while at the same time permitting the outer skin to extend down far enough to provide a nailing flange and to weatherproof the joint below the upper plywood member 24 of the floor by extending the aluminum clad plywood below this upper plywood member of the floor.

The roof 17 has a substantially identical construction to that of the floor 11. Thus there extends along the side of the building the perimeter structural member provided by two by fours 63 and 64 and along the ends the four by four 65. At spaced points splines 60 are provided. The ceiling is provided by a skin which may be paper covered plywood 66 and the top of the roof may be made from sheets of half inch plywood 67. At suitable spacing structural members would extend across the roof between the structural members 64. Insulation material such as styrofoam 68 would be provided in the roof between the structural members. If desired the roof may be fabricated from panels in the same manner as the floor.

The roof has about its perimeter a filler of plywood 71 which will terminate above the outer skins 53 and 61 when the building is assembled as shown in FIGS. 8 and 9. A Z-shaped metal member 42 has one leg underlying member 79 and its other leg overlying wall member 61 to provide a water resistant connection. A waterproofing member 72 extends over the roof and depends below the filler 71 to overlap the top of the exterior side wall skins 53 and 61 as shown in FIGS. 8 and 9 to protect the joint between the roof and the upper edge of the outer aluminum clad skins 53 and 61. The waterproofing may be temporary to protect the package during shipping. Preferably the waterproofing is provided by plastic applied over the top of the roof.

The width of the roof is approximately the same as the width of the floor and thus after the side and end walls have been laid down on the floor as shown in FIG. 6 the roof may be supported on the side walls with the perimeter structural member provided by the two by fours 63 and 64 at each side of the roof supported on the top and bottom plates of the walls thus transmitting the weight of the roof directly to the structural members of the wall and thence to the structural members of the floor and the skid. This relationship is shown in FIG. 6. Preferably vertical pieces of plywood (not shown) extend along the sides of the package of FIG. 6 and underlie the depending roof material 72 to provide a weather resistant package for shipping. The floor, walls and roof may be banded together by bands extending about the package in the conventional manner.

Figure 2:
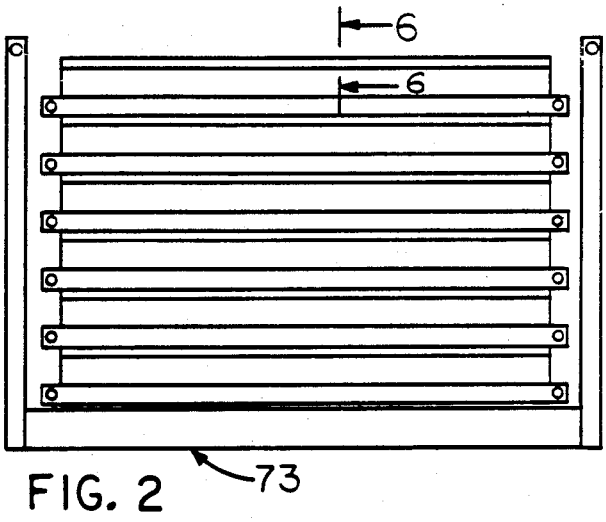
FIG. 2 is a schematic illustration of a number of buildings in accordance with this invention knocked down for shipment and supported on a shipping rack.

As shown in FIG. 2 a shipping skid indicated generally at 73 may support a number of buildings constructed in accordance with this invention for transport to an erection site.

At the site where the building is to be used the roof will be removed and the several side walls positioned about the perimeter of the floor and secured thereto and to each other. The roof will then be placed on the building and secured to the side walls as by the fasteners 69. Thereafter such windows, doors or the like as are desired may be formed in the walls. The windows and doors could of course be installed prior to erection of the walls if desired.

Figure 5:
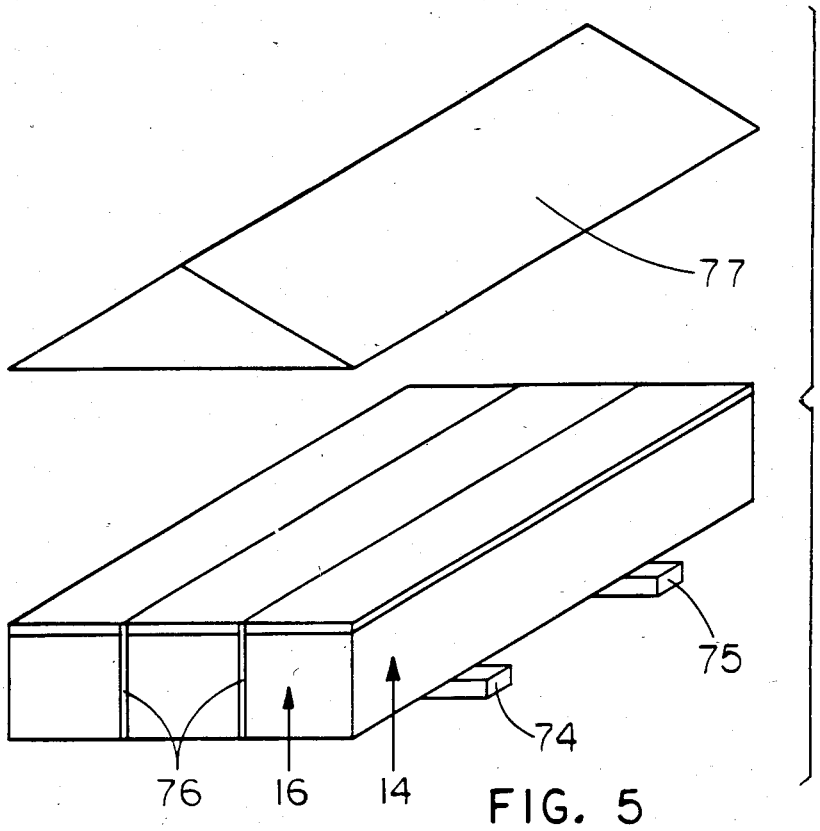
FIG. 5 is a schematic exploded view illustrating three buildings constructed in accordance with this invention in erected form with a roof to be extended over the three buildings.

If the roof covering 72 is only adequate for protecting the package during shipping then a permanent roof may be applied in the field. For instance as shown in FIG. 5 a number of the buildings may be supported on grade beams 74 and 75 with the buildings sitting side by side and adjacent to each other. It will be noted from FIG. 9 that the buildings can be positioned immediately adjacent to each other with only a slight spacing between the exterior walls. Thus doors may be cut through the adjacent walls to provide cross access between several buildings. Of course interior walls might be omitted and where desired the roof supported by posts as will be understood by those skilled in the art.

Where a number of buildings are to be secured together weatherproofing of the space between two buildings should be provided. For instance at the ends vertical strips 76 may be interconnect two adjacent buildings and provide weatherproofing. Also a roof indicated generally at 77 may be constructed over the group of buildings where only a shipping sealer such as fiberglass resin was utilized on the roof. As an alternative where a more permanent type of roofing was applied to each unit the several units assembled together as shown in FIG. 5 might have a roofing connector provided. See for instance the roofing connector shown in U.S. Pat. No. 3,680,273.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A knockdown building comprising:

a rectangular floor comprising a plurality of spaced wooden structural members and upper and lower sheets of structural material secured to the structural members with a lower surface of said lower sheets providing a bottom of said floor;

side walls comprising:

a plurality of spaced structural members and an inner and outer skin of structural metal secured to the structural members;

a roof comprising:

a plurality of spaced structural members and an inner and outer skin of structural material secured to the structural members, said outer skin covered with waterproof materials, and a rectangular skid of angle iron members arranged with the interior side of each angle iron member in engagement with the bottom and a side of said floors;

said angle iron members secured to said floor and secured to each other at the four corners of the floor with one of the angle iron members extending beyond the rectangular skid at each corner of the floor; and a hole in each extending angle iron member for engagment by a lifting device, said floor, side walls and roof being flat and having no protrusions extending upwardly from the floor, inwardly or outwardly of the walls or upwardly or downwardly from the roof other than said angle iron members;

permitting said walls to be stacked on said floor and said roof to be stacked on said walls and buildings to be stacked on each other during shipment.

2. The building of claim 1 wherein said floor is constructed of a plurality of panels extending the width of said floor, each panel is provided by at least one structural member and cellular insulation material bonded to the upper and lower sheets to provide structural panels, and at least one of said panel structural members provides splines between adjacent panels, said structural members including members received between said upper and lower sheets of said panels and extending about the periphery of said floor to secure said panels together.

3. The building of claim 2 wherein said peripheral structural members extending between panels are provided by parallel structural members with offset overlapping ends secured to each other.

4. The building of claim 1 wherein the walls have approximately the same height dimension as the width of the floor and roof and each of the floor, walls and roof have structural members extending about their periphery, said walls when laid down over said floor and said roof when supported on laid down walls having structural members overlying at least some of the peripheral structural members of the floor to transmit the load of the walls and roof to the skid through the structural members.

5. The building of claim 1 wherein said floor is made up of a plurality of panels, said panels each comprising spaced sheets of plywood with expanding cellular insulation material bonded therebetween, a spline provided by a structural member is secured between said spaced sheets of adjacent panels, and structural members extending about the periphery of the floor and positioned between and secured to the spaced sheets of plywood.

6. The building of claim 1 wherein said structural members extending about the periphery of the floor are approximately three and one-half by three and one-half inch in cross-section.

7. The building of claim 1 wherein each of the floor, walls and roof include structural members about their periphery and spaced structural members between peripheral structural members all secured to the structural material on each side of the structural members to provide rigid load supporting structures.

* * * * *